US006425151B2

(12) United States Patent
Barnett

(10) Patent No.: US 6,425,151 B2
(45) Date of Patent: Jul. 30, 2002

(54) CABINET HAVING A FOLD-AWAY BED

(75) Inventor: Robert R. Barnett, San Antonio, TX (US)

(73) Assignee: Somnus Company, L.L.P., San Antonio, TX (US)

( * ) Notice: Subject to any disclaimer, the term of this patent is extended or adjusted under 35 U.S.C. 154(b) by 0 days.

(21) Appl. No.: 09/770,140

(22) Filed: Jan. 26, 2001

Related U.S. Application Data

(60) Provisional application No. 60/178,412, filed on Jan. 27, 2000.

(51) Int. Cl.[7] ..... A47C 17/58

(52) U.S. Cl. ..... 5/159.1; 5/149; 5/138; 5/160

(58) Field of Search ..... 5/3, 4, 6, 138, 5/149, 150.1, 153, 155, 159.1, 160, 167, 174

(56) References Cited

U.S. PATENT DOCUMENTS

| | | | | |
|---|---|---|---|---|
| 1,757,068 A | | 5/1930 | Wikman et al. | |
| 2,313,813 A | | 3/1943 | Ebbert | |
| 2,605,480 A | * | 8/1952 | Miesner | 5/159.1 |
| 2,768,389 A | | 10/1956 | Caroleo | |
| 3,602,927 A | * | 9/1971 | Wyss | 5/174 |
| 3,858,253 A | | 1/1975 | Lauzon | |
| 3,863,281 A | * | 2/1975 | Tosic | 5/149 |
| 3,922,734 A | | 12/1975 | Herrera | |
| 4,318,195 A | | 3/1982 | Reppas | |
| 4,793,011 A | * | 12/1988 | Eve | 5/149.1 |
| 4,999,865 A | * | 3/1991 | Sauder et al. | 5/159.1 |

FOREIGN PATENT DOCUMENTS

| | | | | |
|---|---|---|---|---|
| FR | 834437 | * | 8/1938 | 5/155 |
| FR | 995290 | * | 11/1951 | 5/155 |

* cited by examiner

*Primary Examiner*—Michael F. Trettel
(74) *Attorney, Agent, or Firm*—Jackson Walker L.L.P.

(57) ABSTRACT

The present invention provides an article of furniture in the form of a cabinet and folding bed combination that provides a comfortable sleeping surface for the user. The present invention provides a mattress assembly capable of receiving a mattress having a thickness of up to 4" and capable of being folded in spaced relation for storage inside the cabinet. The present invention is designed for convenient storage inside the cabinet without the use of a locking mechanism. The unique design of the present invention allows the center of gravity of the front panel to change as it is rotated so that the weight of the mattress assembly assists in closing the front panel and keeps the front panel firmly closed against the front opening of the cabinet.

5 Claims, 6 Drawing Sheets

CABINET HAVING A FOLD-AWAY BED

This utility application is based upon and claims priority from a provisional patent application entitled "Cabinet with Fold-Away Bed" having a filing date of Jan. 27, 2000 and a Ser. No. of 60/178,412.

FIELD OF THE INVENTION

The present invention relates generally to a combination folding bed and article of furniture and more particularly to a cabinet in which a bed consisting of a mattress frame and mattress can be stored when not in use and folded outside of the cabinet during use.

BACKGROUND OF THE INVENTION

Foldable beds, and particularly those folding beds which are stored within other furniture items, are an attractive bedding option for consumers with restricted living space. Typically a foldable bed folds upon itself either one or two times for easy storage, then unfolds into a bed for sleeping. The bed generally includes a mattress that is sufficiently flexible to fold upon itself and a frame which serves as both the supporting bed frame and a restraining unit for the mattress in its folded position.

U.S. Pat. No. 3,922,734, the specification and drawings of which are hereby incorporated by reference, describes an article of furniture containing a folding bed unit. The bed unit described by the '734 patent attaches to an inside face of the front panel of the cabinet using a thin metal strip disposed perpendicularly relative to the rotational axis of the front panel. The use of a central, perpendicularly disposed point of attachment creates an unstable foundation for the mattress frame. Specifically, a user resting upon the mattress frame is likely to experience a "see saw" movement of the mattress frame if he or she attempts to roll over or otherwise move an axial direction. This condition is hardly conducive to a restful night's sleep.

U.S. Pat. No. 1,757,068, the specification and drawings of which are hereby incorporated by reference, provides two embodiments of a cabinet having a collapsible bed unit. The first requires the user to unfold the bed frame and then place an outside mattress upon the outstretched frame, thus requiring separate storage of the mattress. The second embodiment of the '068 invention requires the use of a hinged or jointed mattress. While resting upon such a mattress, the user is likely to experience an unequal weight distribution and as a result have an uncomfortable sleeping experience.

SUMMARY OF THE INVENTION

Accordingly, the present invention provides an article of furniture in the form of a cabinet and folding bed combination that provides a comfortable sleeping surface for the user. The present invention provides a mattress assembly capable of receiving a mattress having a thickness of up to 4" and capable of being folded in spaced relation for storage inside the cabinet.

The present invention is designed for convenient storage inside the cabinet without the use of a locking mechanism. The unique design of the present invention allows the center of gravity of the front panel to change as it is rotated so that the weight of the mattress assembly assists in closing the front panel and keeps the front panel firmly closed against the front opening of the cabinet.

The mattress assembly of the present invention is attached to the front panel of the cabinet using attachment strips that span substantially the entire width of the inside surface of the front panel. This provides a stable foundation for the mattress assembly and prevents the "see saw" movement seen in the prior art.

DETAILED DESCRIPTION OF THE INVENTION

Figure 1:
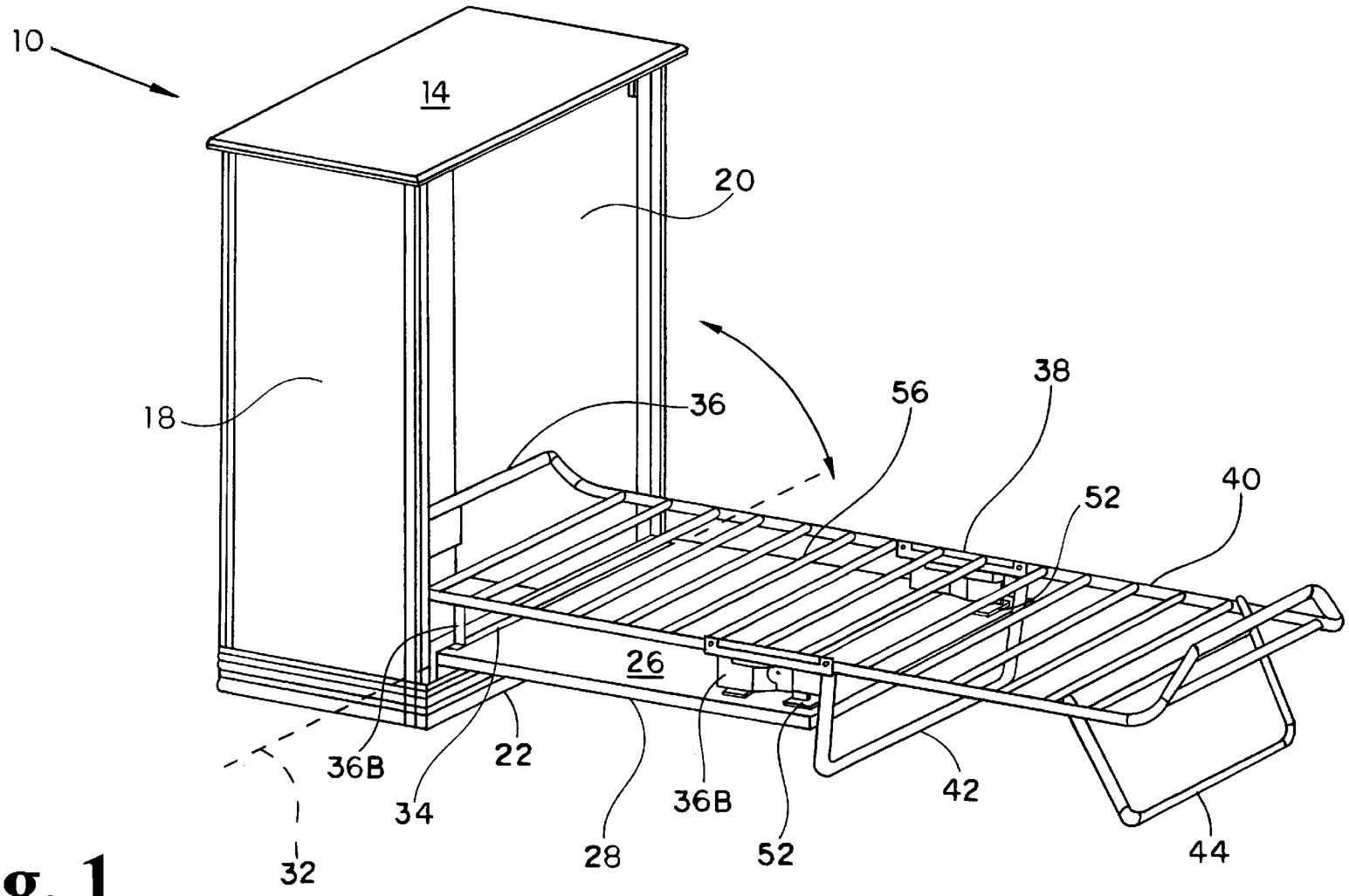
FIG. 1 is a perspective view illustrating the mattress assembly of the present invention in an unfolded position without a mattress.

The present invention, as illustrated in the Figures, is herein described as an article of furniture in the form of a combination cabinet and folding bed. The present invention is an attractive (10) cabinet sized to receive an articulate mattress assembly (12).

Referring to FIGS. 1, 2, 5 and 7, the cabinet (10) has a top wall (14), a back wall (16), spaced-apart vertical side walls (18), a front opening (20), a front molding (22) and a front panel (24). The dimensions of the cabinet (10) may be adapted to accommodate any size mattress (30), including single and double sized mattresses. In one embodiment of the present invention, the top of the cabinet (10) has substantially the same dimensions as the bottom of the cabinet. This feature of the present invention allows the the cabinet (10) to be packaged and shipped without the need for custom packaging materials.

Figure 2:
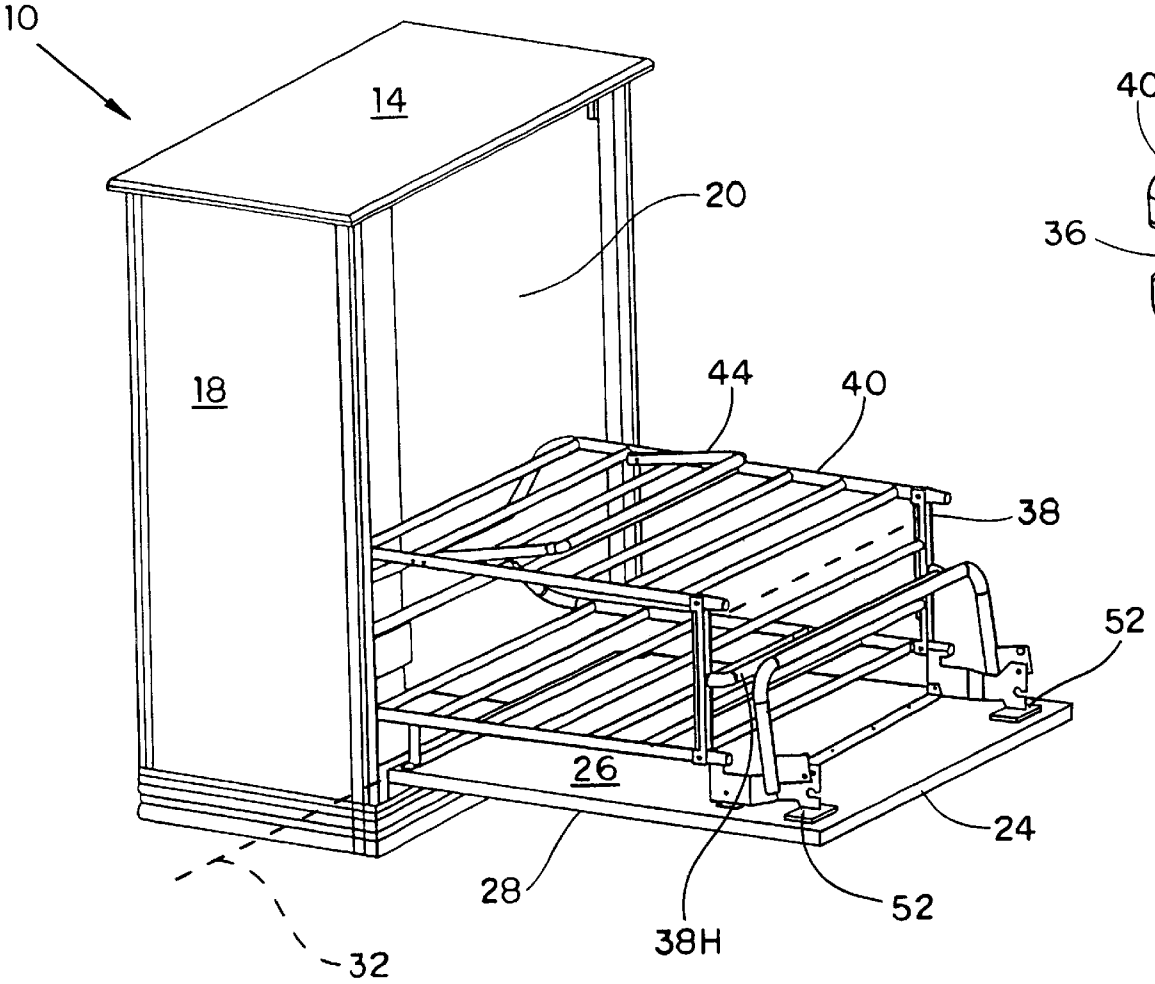
FIG. 2 is a perspective view illustrating the mattress assembly of the present invention in a folded position without a mattress.

Referring to FIGS. 1 and 2, the front panel (24) of the cabinet (10) is hingedly attached to the front molding (22) of the cabinet. In one embodiment of the present invention, the front panel (24) is attached to the front molding (22) using a piano hinge (not shown). This hinged attachment allows the front panel (24) to rotate about an axis of rotation (32) between a substantially vertical position and a substantially horizontal position. Attachment strips (34) are mounted to the inside surface of the front panel (24) to provide a foundation for the mattress assembly (12). In the preferred embodiment, two attachment strips (34) are attached to the inside surface (26) of the front panel (24) in a plane parallel to the axis of rotation (32) of the front panel. These attachment strips may span the entire width of the front panel (24) to provide a stable foundation for the mattress assembly (12).

Figure 5:
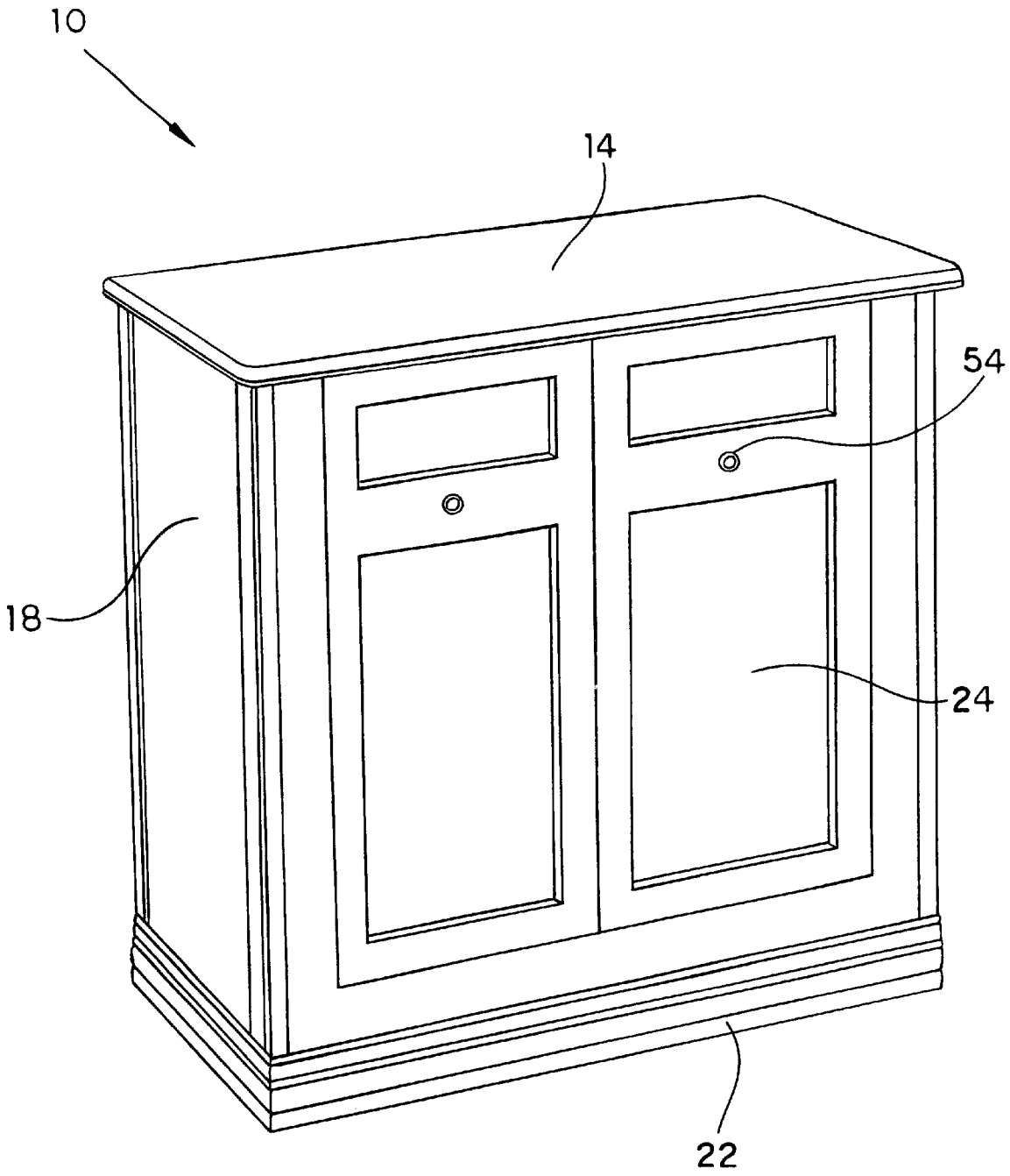
FIG. 5 is a perspective view of the cabinet of the present invention.
Figure 6:
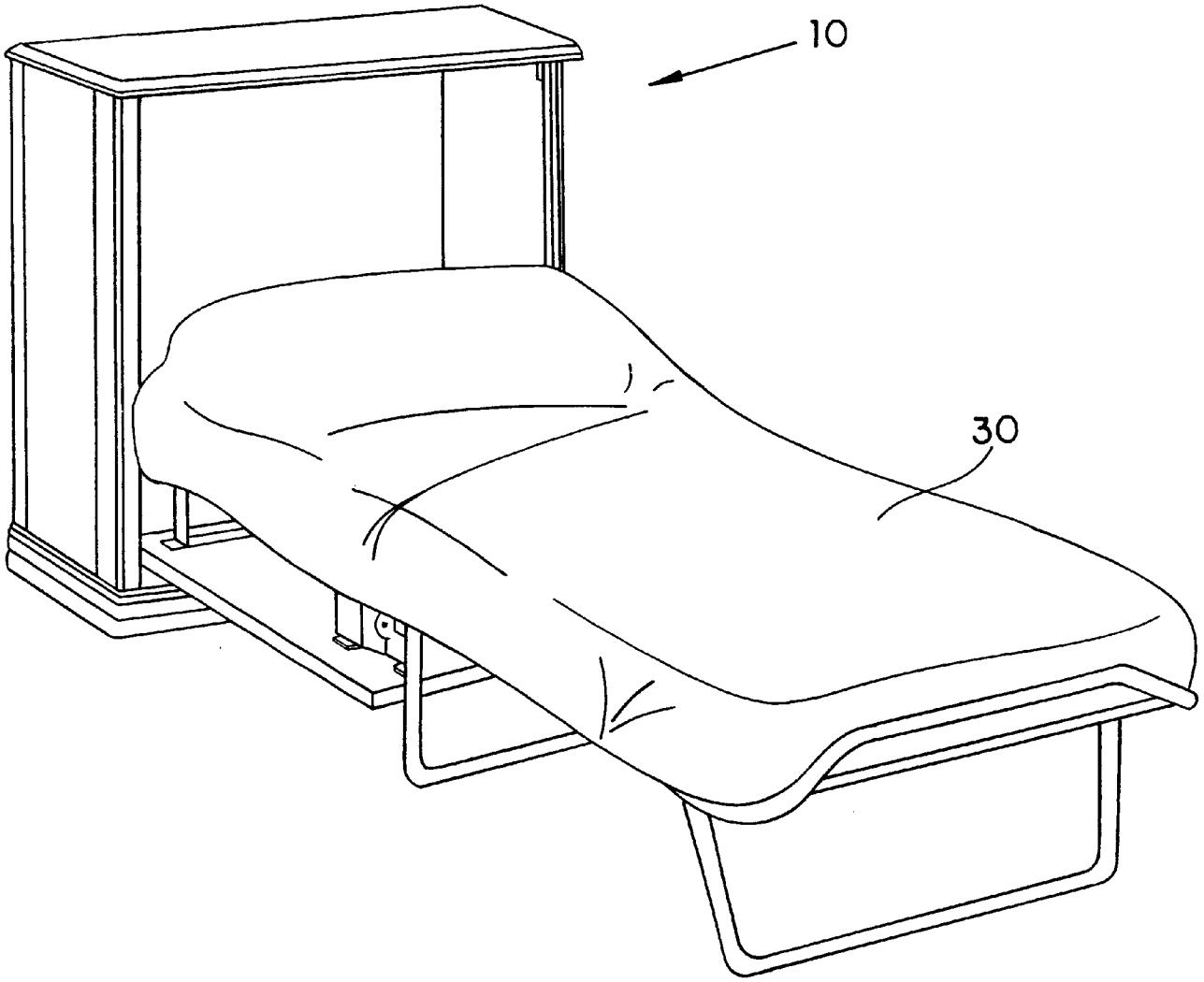
FIG. 6 is a perspective view of the present invention in the unfolded position with mattress and pillow.
Figure 7:
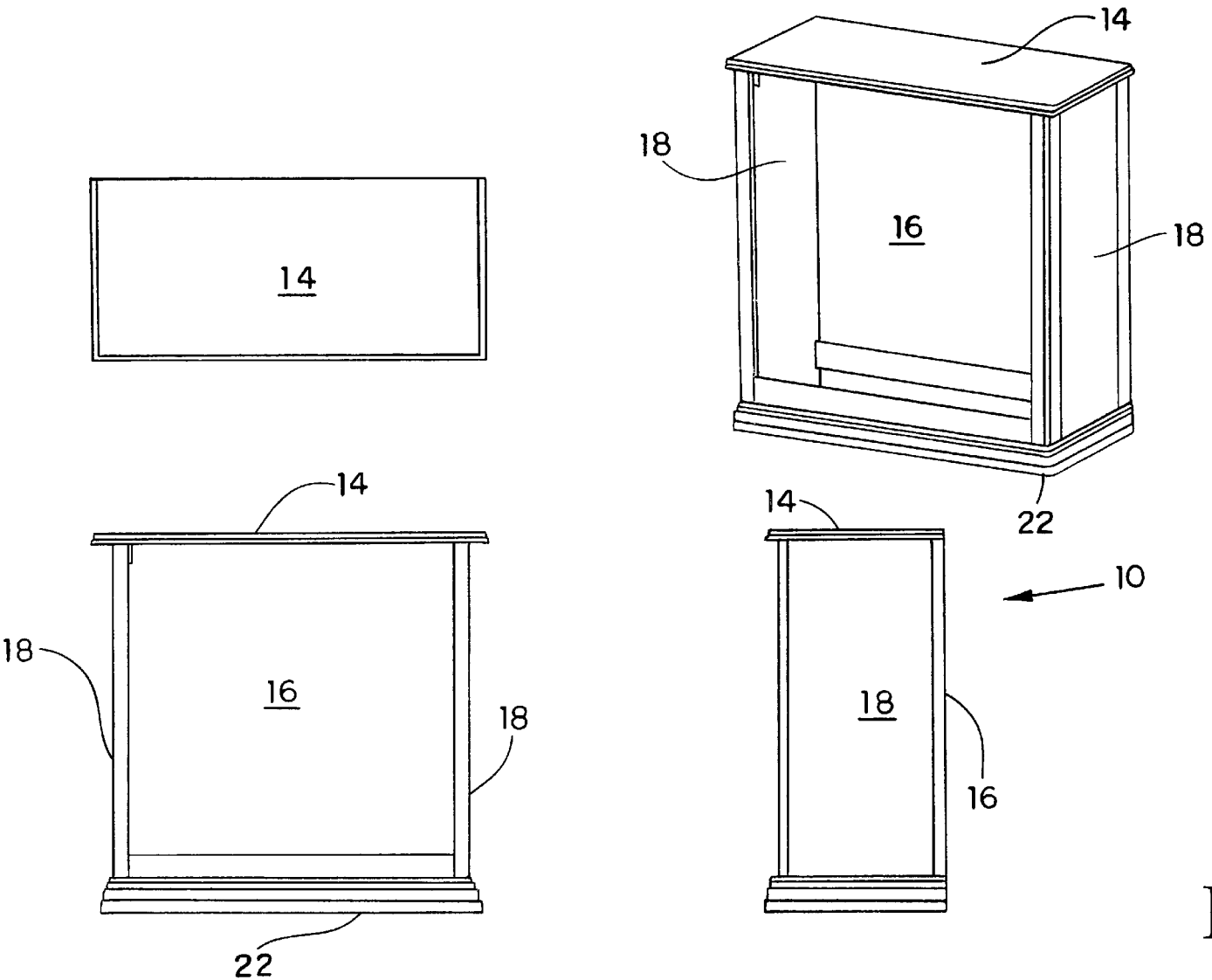
FIG. 7 illustrates the cabinet of the present invention from various angles without the front panel.

Referring to FIG. 5, the front panel (24) of the cabinet (10) is composed of ⅜" plywood decorated with solid wood framing. Pull knobs (54) are attached to the outside surface (28) of the front panel (24) to facilitate easy movement of the front panel by the user. The side walls (18) of the cabinet (10) are composed of MDF board and are decorated with solid wood molding. The back wall of the cabinet is composed of ¼" compressed board while the top wall is composed of MDF board decorated with solid wood molding. The exterior of the cabinet may be decorated in any attractive manner including PVC lamination or multiple coats of paint.

Referring to FIGS. 1–4, the mattress assembly (12) of the present invention has a head frame (36), a hinge member (38) and a foot frame (40). The head frame, hinge member, and foot frame are capable of being folded upon one another in spaced relation to receive a mattress (30). In one embodiment, the mattress assembly (12) is designed to accommodate a mattress having a thickness between 3-½" and 4". The head frame (36) has one or more brackets (36B) for attachment to one or more attachment strips (34) mounted to the inside surface (26) of the front panel (24). In one embodiment, the head frame (36) has a bracket (36B) mounted at both ends, each bracket attached to an attachment strip (34).

The hinge member (38) attaches to the head frame (36) at one end and to the foot frame (40) at the other end. This is accomplished using nuts and bolts which allow rotation of the mattress assembly (12). The mattress assembly may be folded and stored when not in use. Alternatively, the mattress assembly (12) may be removed from the cabinet (10) by rotating the front panel (24) from a substantially vertical position to a substantially horizontal position. Once the front panel (24) is rotated, the user need only unfold the bed, as described below, to enjoy the convenience and comfort of the present invention.

The hinge member (38) is further equipped with a handle member (38H). The handle member increases the rigidity of the hinge member (38) and also provides a convenient point of contact for the user. The mattress assembly (12) may be composed of any strong and durable material, preferrably, round tubular steel. Each component of the mattress assembly (12) may also be equipped with steel cross members (56) to provide additional rigidity and support.

A middle support member (42) and a foot support member (44) provide additional stability to the mattress assembly (12). These support members (42 and 44) are capable of engaging the floor when the mattress assembly (12) is unfolded. The middle support member (42) is rotatably attached to the hinge member (38) while the foot support member (44) is rotatably attached to the foot frame (40). To provide additional stability, both of these support members (42 and 44) may be attached to the mattress assembly (12) via a slot and pin arrangement. This arrangement allows each support member (42 and 44) to be locked into an open position. In one embodiment of the present invention, both the middle support member (42) and the foot support member (44) are equipped with rubberized feet (46). These rubberized feet minimize slippage and prevent marring of the floor by the support members.

Figure 4:
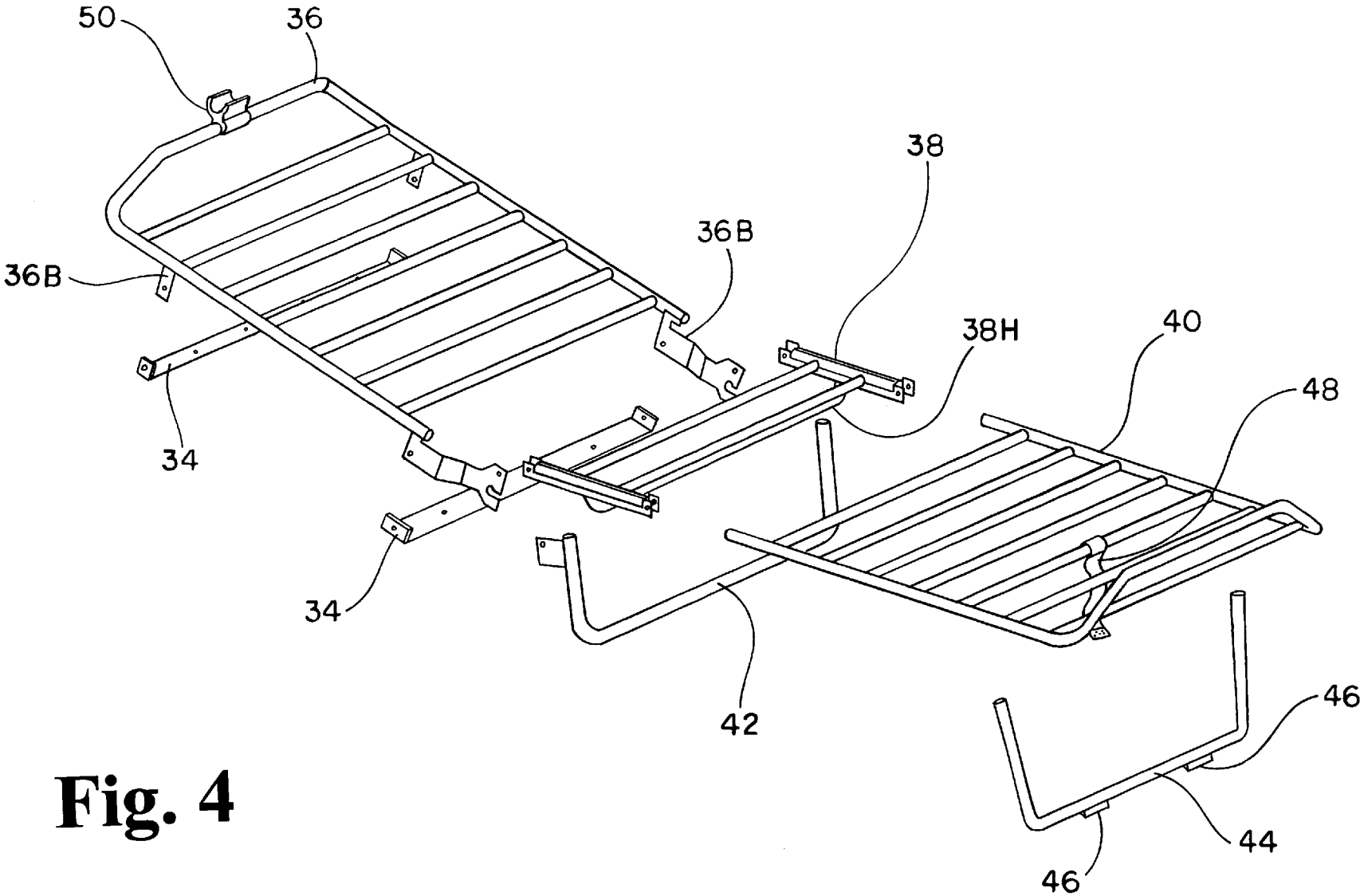
FIG. 4 is a perspective view of the mattress assembly of the present invention apart from the cabinet with a close-up view of the hinge mechanism.

Referring to FIG. 4, the present invention is designed to ensure that the cabinet (10) is protected. To illustrate, the mattress assembly (12) of the present invention uses a fabric hook and loop fastener (48) to secure the foot support member (44) to the foot frame (40) during storage of the mattress assembly (12). One or more retaining clips (50), mounted to the head frame (36), are used to secure the foot frame (40) to the head frame during storage of the mattress assembly (12). These features ensure that the inside of the cabinet (10) is not damaged during storage of the mattress assembly (12).

Referring to FIGS. 1 and 5, the present invention provides assembly mounts (52) to prevent the head frame (36) from damaging the inside surface (26) of the front panel (24). The assembly mounts (52) are metal pieces strategically mounted to the inside surface (26) of the front panel (24) to prevent direct contact between the head frame (36) and the front panel. In one embodiment of the present invention, the assembly mounts (52) are mounted to the front panel (24) to engage extending brackets of the head frame (36) which would otherwise contact the inside surface (26) of the front panel (24).

Figure 3:
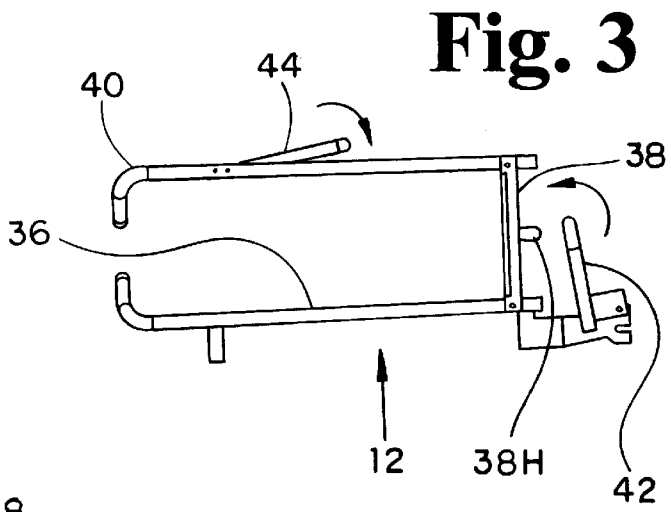
FIG. 3 is a side elevation view of the mattress assembly of the present invention apart from the cabinet.

Referring to FIGS. 1, 2 and 3, the present invention may also be described as a method of using and storing an article of furniture having the form of a combination cabinet and folding bed. In operation, the cabinet (10) would normally be stored in the closed position. If the bed is to be used, the front panel (24) is opened by grasping the attached pull knobs (54). The front panel (24) is pivoted from a substantially vertical position to a substantially horizontal position. As the front panel (24) is pivoted, the middle support member (42) is rotated from a closed position to an open, useable, and locked position. In addition to providing additional stability, the middle support member (42) provides the necessary height to keep the front panel (24) from scraping the floor.

Next, the foot frame (40) is unsnapped from one or more retaining clips (50) and pivoted into an open position. Simultaneous with the opening of the foot frame (40), the foot support member (44) is rotated into its open position. The angle between the foot support member (44) and the foot frame (40) is designed so as to keep the foot support member (44) in the open position when the bed is in use. The mattress (30) is then unfolded and centered on the mattress assembly (12). The mattress (30) is now ready to be used.

For storage of the bed, the process is reversed. First, the foot frame (40) is pivoted, forcing the mattress (30) to fold until the foot frame (40) snaps into the retaining clip (50). The space between the head frame (36) and foot frame (40) while in this folded and clipped position is approximately nine inches. As described above, this provides sufficient space for a three-and-half to four inch mattress (30) to be folded along with the necessary bedding.

The middle support member (42) is then unlocked from the pin and slot combination and pivoted into its upright and stored position. The foot support member (44) is also pivoted to its almost horizontal stored position. The front panel (24) is now lifted so that it swings into the front opening of the cabinet (10). As the front panel (24) is pivoted from a substantially horizontal position to a substantially vertical position, the center of gravity of the front panel (24) changes so that the weight of the mattress assembly (12) assists in closing the front panel and keeping the front panel firmly closed against the front opening (20) of the cabinet (10). This feature of the present invention allows for storage of the mattress assembly (12) without the use of a locking mechanism.

Although the invention has been described with reference to specific embodiments, this description is not meant to be construed in a limited sense. Various modifications of the disclosed embodiments, as well as alternative embodiments of the invention, will become apparent to persons skilled in the art upon the references to the description of the invention.

I claim:

1. An article of furniture in the form of a combination cabinet and folding bed comprising:

a cabinet having a front opening, spaced-apart vertical side walls, a top wall, a back wall and a front molding;

a front panel having a first end hingedly attached to said front molding such that said front panel is capable of rotation about an axis of rotation between a substantially vertical position wherein said front opening is covered and a substantially horizontal position;

one or more attachment strips removably secured to an inside surface of said front panel;

an articulate mattress assembly having a head frame, a foot frame and a hinge member, said head member having one or more brackets removably secured to said attachment strips, said hinge member rotatably secured at a first end to said head frame and rotatably secured to said foot frame at a second end such that said mattress assembly may be stored within said cabinet, said head frame, said foot frame and said hinge member capable of being folded upon each other in spaced relation to receive a mattress;

a middle support member rotatably secured to said hinge member for engaging the floor, said middle support member attached to said hinge member using a slot and pin arrangement; and, a foot support member rotatably secured to said foot frame for engaging the floor.

2. An article of furniture in the form of a combination cabinet and folding bed comprising:

a cabinet having a front opening, spaced-apart vertical side walls, a top wall, a back wall and a front molding;

a front panel having a first end hingedly attached to said front molding such that said front panel is capable of rotation about an axis of rotation between a substantially vertical position wherein said front opening is covered and a substantially horizontal position;

one or more attachment strips removably secured to an inside surface of said front panel;

an articulate mattress assembly having a head frame, a foot frame and a hinge member, said head member having one or more brackets removably secured to said attachment strips, said hinge member rotatably secured at a first end to said head frame and rotatably secured to said foot frame at a second end such that said mattress assembly may be stored within said cabinet, said head frame, said foot frame and said hinge member capable of being folded upon each other in spaced relation to receive a mattress, said foot frame having a fabric hook and loop fastener capable of securing said foot support member to said mattress assembly;

a middle support member rotatably secured to said hinge member for engaging the floor; and, a foot support member rotatably secured to said foot frame for engaging the floor.

3. An article of furniture in the form of a combination cabinet and folding bed comprising:

a cabinet having a front opening, spaced-apart vertical side walls, a top wall, a back wall and a front molding;

a front panel having a first end hingedly attached to said front molding such that said front panel is capable of rotation about an axis of rotation between a substantially vertical position wherein said front opening is covered and a substantially horizontal position;

one or more attachment strips removably secured to an inside surface of said front panel;

an articulate mattress assembly having a head frame, a foot frame and a hinge member, said head member having one or more brackets removably secured to said attachment strips, said hinge member rotatably secured at a first end to said head frame and rotatably secured to said foot frame at a second end such that said mattress assembly may be stored within said cabinet, said head frame, said foot frame and said hinge member capable of being folded upon each other in spaced relation to receive a mattress, said hinge member having a handle member for providing additional rigidity to said hinge member and for grasping by the user;

a middle support member rotatably secured to said hinge member for engaging the floor;

and, a foot support member rotatably secured to said foot frame for engaging the floor.

4. An article of furniture in the form of a combination cabinet and folding bed comprising:

a cabinet having a front opening, spaced-apart vertical side walls, a top wall, a back wall and a front molding;

a front panel having a first end hingedly attached to said front molding such that said front panel is capable of rotation about an axis of rotation between a substantially vertical position wherein said front opening is covered and a substantially horizontal position;

one or more attachment strips removably secured to an inside surface of said front panel; said attachment strips mounted in a plane parallel to said axis of rotation of said front panel and span substantially the entire width of the inside surface of said front panel;

an articulate mattress assembly having a head frame, a foot frame and a hinge member, said head member having one or more brackets removably secured to said attachment strips, said hinge member rotatably secured at a first end to said head frame and rotatably secured to said foot frame at a second end such that said mattress assembly may be stored within said cabinet, said head frame, said foot frame and said hinge member capable of being folded upon each other in spaced relation to receive a mattress;

a middle support member rotatably secured to said hinge member for engaging the floor; and, a foot support member rotatably secured to said foot frame for engaging the floor.

5. An article of furniture in the form of a combination cabinet and folding bed comprising:

a cabinet having a front opening, spaced-apart vertical side walls, a top wall, a back wall and a front molding;

a front panel having a first end hingedly attached to said front molding such that said front panel is capable of rotation about an axis of rotation between a substantially vertical position wherein said front opening is covered and a substantially horizontal position, said front panel composed of ⅜" plywood having an outside surface having pull knobs for facilitating movement of said front panel;

one or more attachment strips removably secured to an inside surface of said front panel, said attachment strips mounted to said front panel in a plane parallel to said axis of rotation of said front panel and spanning substantially the entire width of said inside surface of said front panel;

an articulate mattress assembly having a head frame, a foot frame and a hinge member, said head member having one or more brackets removably secured to said attachment strips, said hinge member rotatably secured at a first end to said head frame and rotatably secured to said foot frame at a second end such that said mattress assembly may be stored within said cabinet, said head frame, said foot frame and said hinge member capable of being folded upon each other in spaced relation to receive a mattress;

a middle support member rotatably secured to said hinge member for engaging the floor, said middle support member having rubberized feet for minimizing slippage of said middle support member upon engaging the floor, said middle support member attached to said mattress assembly using a slot and pin arrangement;

a foot support member rotatably secured to said foot frame for engaging the floor, said foot support member having rubberized feet for minimizing slippage of said foot support member upon engaging the floor;

said foot frame comprising a fabric hook and loop fastener capable of securing said foot support member to said mattress assembly;

said inside surface of said front panel comprising one or more assembly mounts for engaging said mattress assembly; and, said hinge member having a handle member for increased rigidity of said hinge member and for grasping by the user.

* * * * *